US008040032B2

(12) United States Patent
Kovacs

(10) Patent No.: US 8,040,032 B2
(45) Date of Patent: Oct. 18, 2011

(54) SMOOTH ACTION, SPRING LOADED, TWIST LOCKING, RADIAL LUGGED SAFETY CONNECTOR FOR LAMP

(75) Inventor: George Kovacs, Wallingford, CT (US)

(73) Assignee: LightSources Inc., Orange, CT (US)

( * ) Notice: Subject to any disclaimer, the term of this patent is extended or adjusted under 35 U.S.C. 154(b) by 474 days.

(21) Appl. No.: 11/860,658

(22) Filed: Sep. 25, 2007

(65) Prior Publication Data

US 2008/0074027 A1 Mar. 27, 2008

Related U.S. Application Data

(60) Provisional application No. 60/847,017, filed on Sep. 25, 2006.

(51) Int. Cl.

| | |
|---|---|
| ***H01J 5/48*** | (2006.01) |
| ***H01J 5/50*** | (2006.01) |
| ***H01R 13/62*** | (2006.01) |
| ***H01R 13/625*** | (2006.01) |

(52) U.S. Cl. ..... 313/318.01; 439/336

(58) Field of Classification Search ..... 439/336, 439/335, 240, 699.2; 313/318

See application file for complete search history.

(56) References Cited

U.S. PATENT DOCUMENTS

| | | | | |
|---|---|---|---|---|
| 4,473,770 | A | 9/1984 | Baba et al. | |
| 5,166,527 | A * | 11/1992 | Solymar | 250/436 |
| 5,422,487 | A | 6/1995 | Sauska et al. | |
| 5,746,615 | A * | 5/1998 | Ichikawa et al. | 439/227 |
| 5,897,391 | A * | 4/1999 | Takahashi et al. | 439/336 |
| 6,634,902 | B1 | 10/2003 | Pirovic | |
| 6,884,103 | B1 | 4/2005 | Kovacs | |
| 6,976,885 | B2 * | 12/2005 | Lord | 439/680 |
| 2005/0174765 | A1 * | 8/2005 | Dorleijn et al. | 362/217 |
| 2005/0186825 | A1 * | 8/2005 | Yen et al. | 439/336 |

FOREIGN PATENT DOCUMENTS

WO WO2006136026 12/2006

OTHER PUBLICATIONS

International Search Report, Application No. PCT/US2007/020672, Date Mailed Mar. 28, 2008.

* cited by examiner

*Primary Examiner* — Toan Ton
*Assistant Examiner* — Britt Hanley
(74) *Attorney, Agent, or Firm* — Cantor Colburn LLP

(57) ABSTRACT

A safety lamp connector assembly for use with at least one of more lamps comprising: an end cap for the lamp and a smooth action, spring loaded, twist locking, socket for receiving the end cap.

9 Claims, 19 Drawing Sheets

SMOOTH ACTION, SPRING LOADED, TWIST LOCKING, RADIAL LUGGED SAFETY CONNECTOR FOR LAMP

This application claims priority to U.S. provisional application, 60/847,017, filed Sep. 25, 2006, the entire disclosure of which is incorporated herein by reference.

FIELD OF THE INVENTION

This invention generally relates to improvements in lamps, especially ultraviolet lamps used in air and water purifiers.

BACKGROUND

Ultraviolet air or liquid purifiers are known for disinfecting contaminated air or water or other liquid for domestic or commercial use. Such purifiers include at least one lamp for emitting ultraviolet radiation into a chamber filled with contaminated air liquid to kill microorganisms therein. In a conventional manner, the lamp includes two electrodes spaced apart and located within an elongated arc tube containing a gas, particularly mercury vapor with or without additives. A pair of end caps is mounted at the ends of the tube. Each electrode contains two lead wires from the lamp seal each of which, or in some instances only one, are electrically connected to respective contact(s) or terminal pin(s). The lamp is typically inserted endwise into a sleeve installed in the water, other liquid or air purifier with or without the sleeve. To simplify insertion and electrical connection, the pins are conveniently mounted on one of the end caps. When the electrodes are energized by voltage from an electrical power supply, an electrical discharge is initiated in the gas between the electrodes. This discharge reacts with a layer of a radiation-emitting material coated on an interior surface of the arc tube and causes ultraviolet radiation to be emitted from the lamp in a manner well known in the art.

There are many different types of lamps that have a base or end cap that can be connected with a socket to provide electrical connections to the lamps. The end cap and socket must be constructed to permit replacement of the lamp while securely holding the lamp. This may be particularly important in certain applications where vibration or movement of the lamp or lamp fixture could result in unintentional separation between the lamp's end cap and the socket. Additionally, the electrical connections must remain secure.

In some applications where a multiplicity of contact pins and/or pin orientations is utilized, it is often difficult to align the contact pins to make the electrical connection necessary to operate the lamp. Often, the contact pins may become misaligned or bent due to their extension or projection from the base of the lamp, preventing their insertion into a socket. It may also be possible to insert the end cap into a socket such that the contacts are not connected with the proper terminals in the socket, resulting in improper operation of the lamp. Also, on a typical "slide into place" male/female pin connector there is no locking or twist locking and thus the pins may slide out and become disconnected easily by vibration for example.

An example of an ultraviolet lamp of the type described above is disclosed in U.S. Pat. No. 5,166,527 ('527), which uses a stepped base with a multi-pin connector, all of the contents of which are incorporated herein by reference and shows well known water and air purification arrangements using a lamp. The '527 patent discloses a lamp or bulb, used as an ultraviolet lamp for use in an air or water purifier, comprising an elongated, hollow arc tube extending along a longitudinal axis between opposite end regions. The tube contains a gas, preferably mercury vapor with or without additives. A pair of electrodes is spaced apart along the longitudinal axis. The electrodes are respectively mounted within the arc tube at the end regions thereof. A pair of end caps is respectively mounted at the end regions of the arc tube. A first electrical contact or pair of electrical contacts or terminal pins extends in mutual parallelism along the longitudinal axis and is electrically connected to one or both of the electrode lead wires. A second electrical contact or pair of electrical contacts or terminal pins extends in mutual parallelism along the longitudinal axis and is electrically connected to one or both of the other of the electrode lead wires. Both pairs of pins are mounted on, and extend outwardly along the longitudinal axis of, one of the end caps. A wire conductor is, or two wire conductors are, located exteriorly of the tube and electrically connected to one pin or one pair of pins at one end region of the tube, as well as to the electrode at the other end region of the tube. This design is mainly designed to prevent electrical arcing and does not lock in place.

As noted in WO/2006/136026 to Elku et al. which is a variation of the slide-on pin connector above, a potential problem with this approach is that in many applications, the radiation lamp is immersed in or near a flow of air or water and turbulence created within that water treatment system invariably imparts a vibratory motion to the lamps which frequently results in lamps being vibrated or shaken loose of its electrical connection base or socket thereby causing the lamps to be rendered completely or intermittently inoperative. When such an event occurs, the water being treated may not be fully disinfected. The prior art has attempted to address this problem by using a relatively complicated mechanical connection (e.g., a so-called "push-and-twist" connection) to secure the lamp to the connection base. See, for example, U.S. Pat. No. 5,422,487 to Sauska et al. and U.S. Pat. No. 6,884,103 to Kovacs. The potential problem with these approaches is the complexity of the mechanical connection between the lamp and the base unit requiring the use of springs, specialized connection lugs and the like. Further, a connection system which is predicated on a dual motion system such that pushing and twisting if used incorrectly for example may give rise to higher incidents of lamp breakage, electrical shock, and other damage to the lamp by field personal. Therefore, eliminating a forceful "push" necessary to deflect a heavy locking spring in a "push and twist" lock would be beneficial because the typically glass lamp would be subject to reduced force and stress.

Also, it is important for safety that lamps of proper wattage be used for safety, heat, and fire concerns, thus a unique keying system which only allows lamps of proper wattage to be inserted into the base will also help safety.

Accordingly, there remains the need in the art for a safety lamp device, particularly a radiation lamp, which will provide a reliable, locking, and secure from movement electric connection, yet be relatively inexpensive, uncomplicated, durable, rugged, and simple to implement with smooth operation and with reduced force and stress on the lamp for safety purposes. Also, a lamp that reduces the chance of electrical shock is needed for safety purposes.

Thus, there continues to be a need for improved lamp base designs, particularly ultraviolet lamps.

SUMMARY OF THE INVENTION

In accordance with an embodiment, a safety lamp connector apparatus is provided for use with at least one or more lamps comprising an end cap for the lamp, the end cap comprising a hollow tubular section for receiving the lamp; a plurality of outer end cap terminals extending radially outwards from the hollow tubular section; and a plurality of inner end cap terminals electrically connected to the plurality of outer end cap terminals; and a smooth action twist socket for receiving the end cap, the twist socket comprising: an interior socket wall; a plurality of straight and axially oriented terminal grooves cut into the interior socket wall; a plurality of straight horizontal grooves each connected to the axially oriented terminal grooves at a predetermined and individually set depth inside the socket and orientated substantially perpendicular to the axially orientated grooves; a plurality of smooth action and resiliently biased metal interior curved socket contacts having a base end located towards the bottom of the straight and axially orientated grooves and also having a top end which is resiliently biased towards the top of a respective straight horizontal groove so as to structural form a curved resilient member which can be depressed towards the bottom of the twist socket by insertion of, and then the twisting of, a respective outer cap terminal on the end cap; and locking cut out sections located at the end of the straight horizontal grooves in which the respective outer cap terminal on the end cap click locks with an axial motion, and comes to rest in the lock cut out section, by being pressed axially by a respective resiliently biased metal interior curved socket contact upon being fully twisted into final position after sliding tangentially along the respective resiliently biased metal interior curved socket contact; an exterior access contact electrically connected to the interior socket contact for connecting wires or any desired electrical power source; and wherein the end cap is structured to be inserted into the socket such that each outer end cap terminal is inserted into a matching sized terminal groove, and each outer end cap terminal contacts a respective resiliently biased metal interior curved socket contact, and subsequently has a smooth action when twisted.

An embodiment may also comprise a safety end cap for a lamp, comprising: a hollow tubular section for receiving the lamp; at least one outer end cap terminal; and at least one inner end cap terminal electrically connected to the at least one outer end cap terminal; wherein the at least one outer end cap terminal is disposed at an end of the tubular section at a predetermined axial position and extends radially outward from a longitudinal axis of the tubular section.

An embodiment may also comprise a smooth action safety socket for receiving a lamp end cap, the socket comprising: a tubular body having an interior surface; at least one terminal groove cut into the interior surface; at least one horizontal groove each connected to the terminal grooves at a predetermined and individually set depth inside the socket and orientated substantially perpendicular to the axially orientated grooves; at least one smooth action, resiliently biased, and curved interior socket contact disposed within the at least one terminal groove; and at least one exterior power input/output contact electrically connected to the at least one interior socket contact.

An embodiment may also comprise a safety lamp connector assembly for use with at least one of more lamps comprising: an end cap for the lamp; a socket for receiving the end cap; and a means for deterring a substitution of unauthorized parts that may be unsafe.

An embodiment may also comprise a lamp connector assembly wherein the means for deterring a substitution of unauthorized parts comprises: a plurality of terminals disposed on an outer surface of the end cap, the plurality of terminals having a predetermined configuration; a plurality of grooves cut into an interior wall of the socket, the plurality of grooves have a predetermined configuration complementary to the configuration of the plurality of terminals; wherein the end cap cannot be inserted into the socket if the configuration of the plurality terminals does not match configuration of the plurality of grooves.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

As used herein, the word "terminal" can mean, but is not limited to, an active terminal or a passive "dummy" terminal. Additionally, the term "lamp" can refer to compact fluorescent lamps and/or UV lamps, among other lamps suitable for the claimed apparatus. Also, the sockets and lamps herein may be mounted or unmounted, for example they may be free floating "pendant" style sockets.

The apparatus described herein is useful in air and water purification systems, among other applications.

Figure 1:
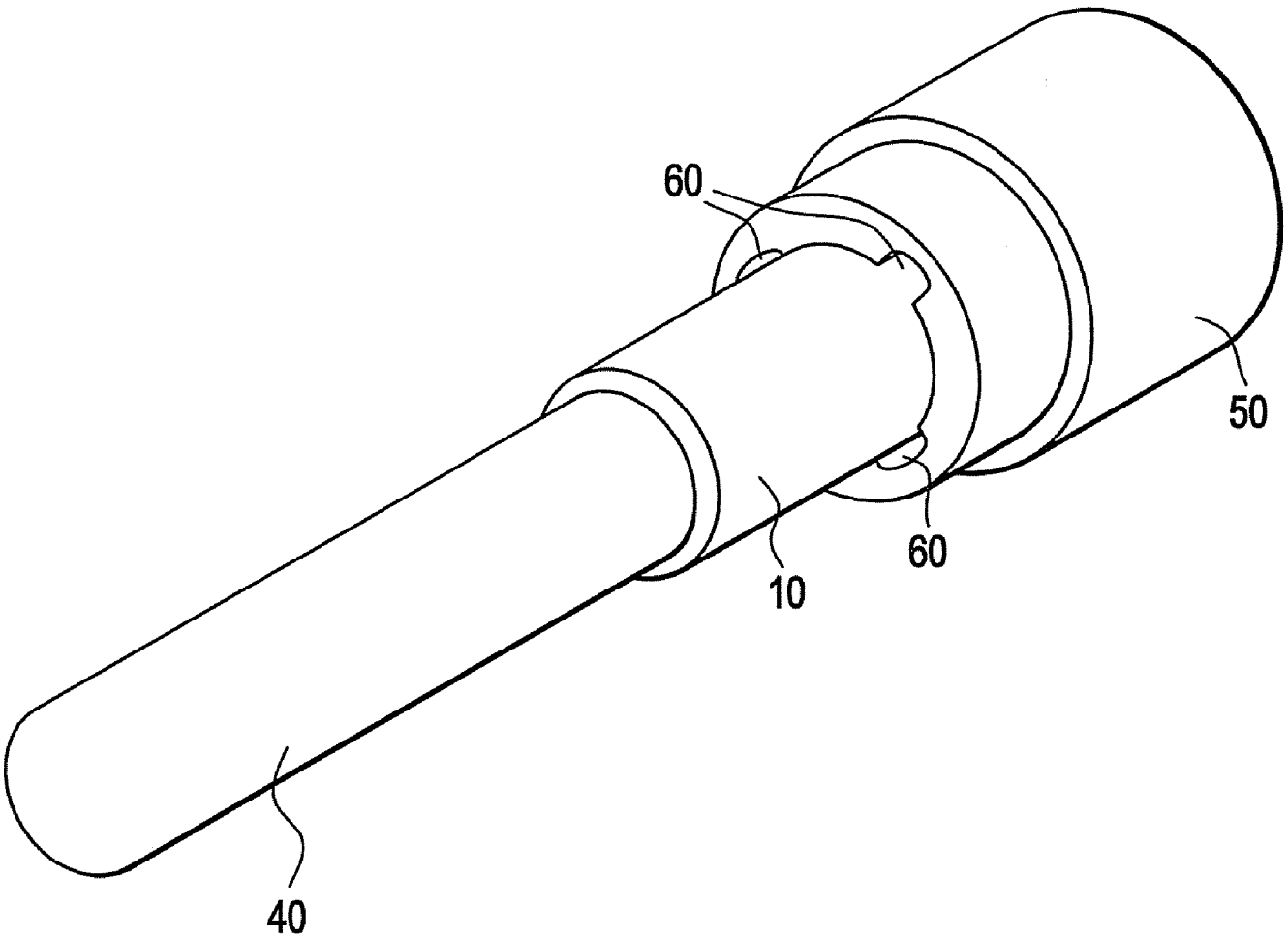
FIG. 1 is a perspective view of a lamp connected to an end cap and inserted into a socket in accordance with one embodiment of the invention.
Figure 4:
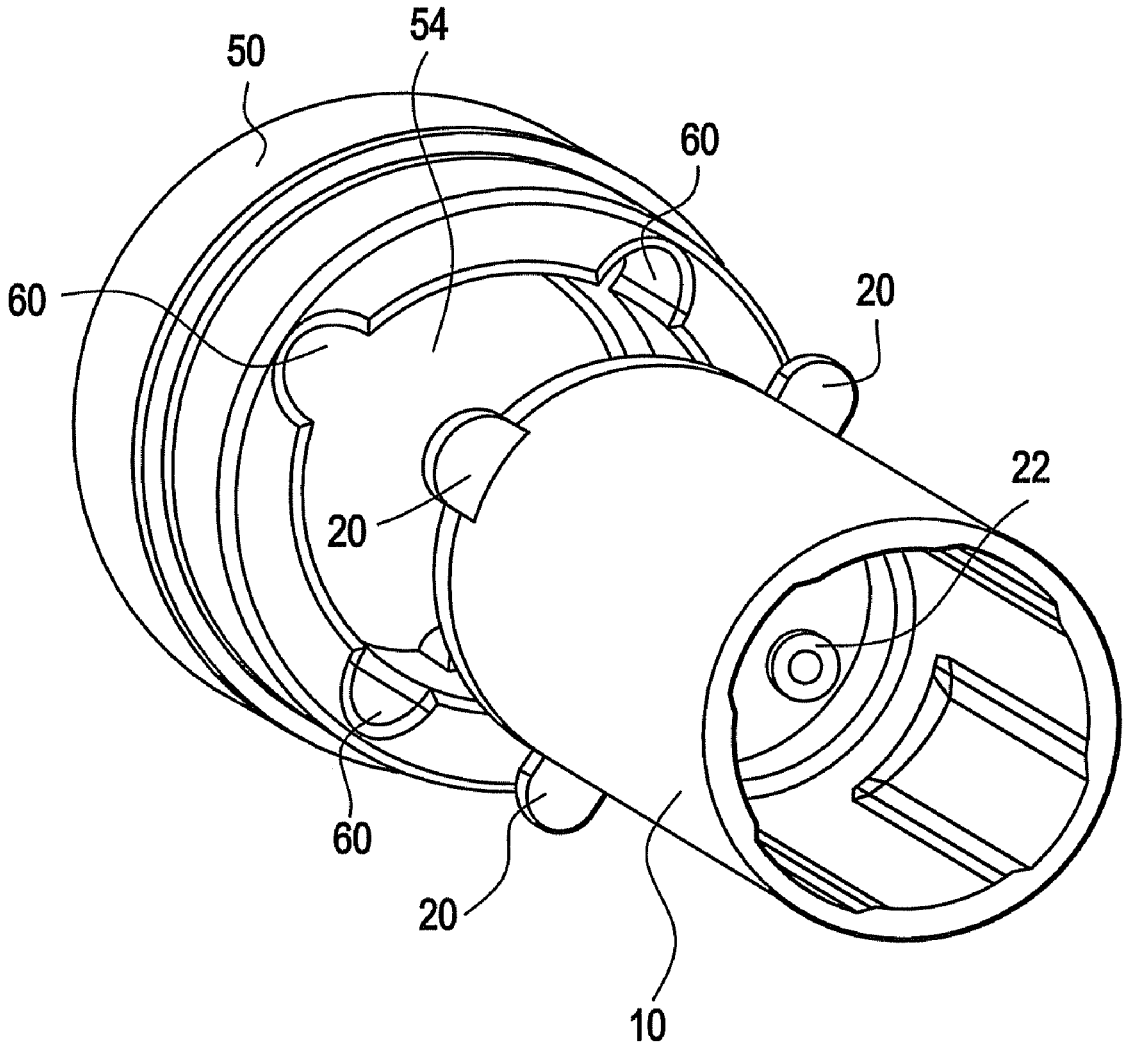
FIG. 4 is a perspective view looking into an end cap and socket according to one embodiment of the invention.

FIGS. 1-6 illustrate one embodiment of the claimed apparatus. End cap 10 comprises a hollow tube, into which a lamp 40 can be inserted. As shown in FIGS. 1 and 4, lamp 40 can be electrically connected to inner end cap terminals 22 located on the inner surface of end cap 10. The inner end cap terminals 22 are electrically connected and or affixed to respective outer end cap terminals 20 located on the outer surface of end cap 10.

End cap 10 is inserted into a socket 50 to make an electrical connection and to connect the lamp 40 and end cap 10 to the socket 50. Socket 50 includes a hollow tubular region, and the inner diameter of socket 50 is slightly larger than the outer diameter of end cap 10. On the inside of socket 50, there is an interior socket wall 52 (see FIG. 2).

Figure 2:
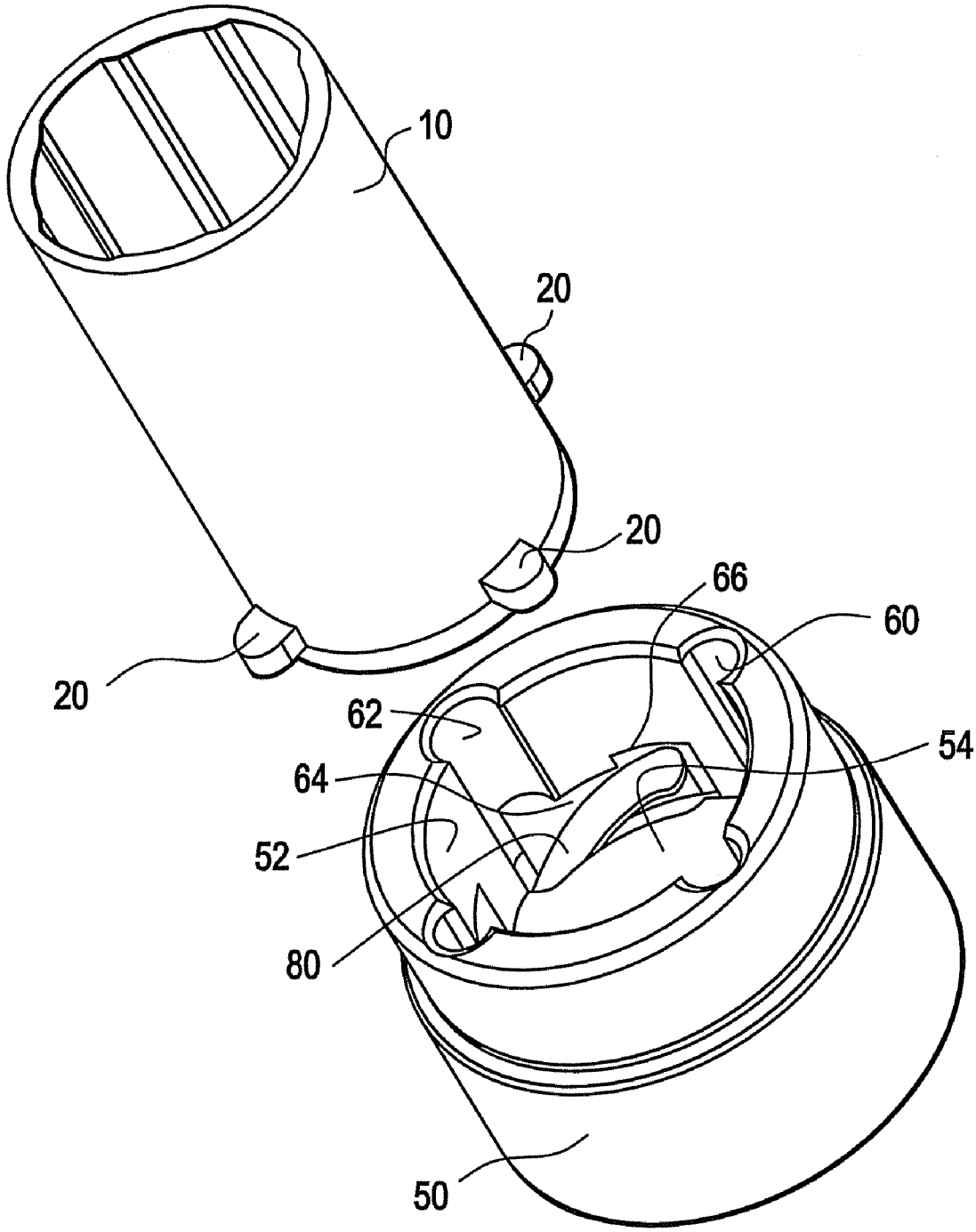
FIG. 2 is a perspective view of an end cap and socket according to one embodiment of the invention.
Figure 3:
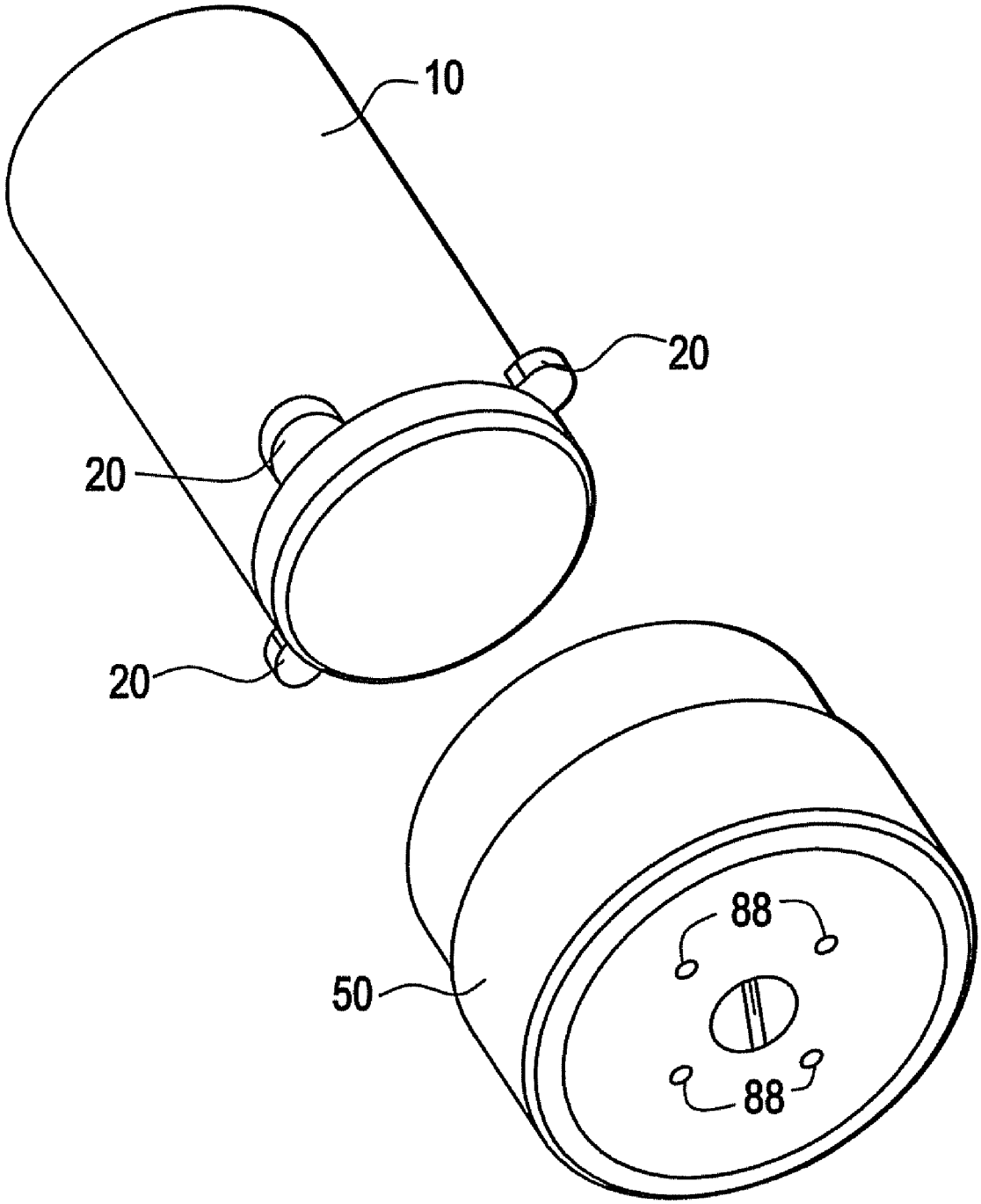
FIG. 3 is a perspective view from below an end cap and socket according to one embodiment of the invention.
Figure 5A:
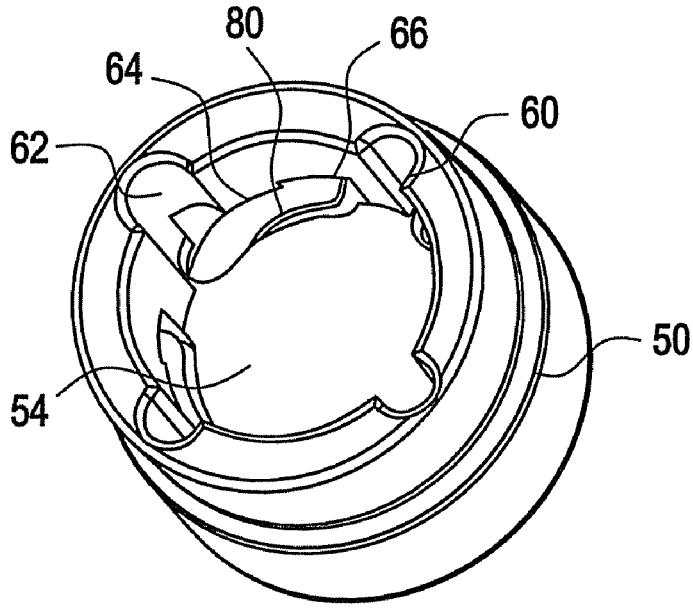
FIG. 5*a* is a perspective view looking into a socket according to one embodiment of the invention.
Figure 5B:
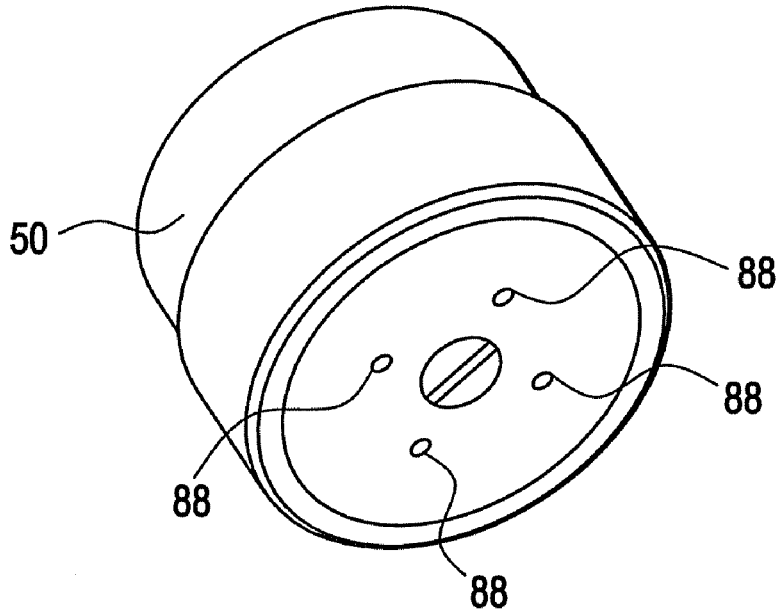
FIG. 5*b* is a perspective view from below a socket according to one embodiment of the invention.

Socket 50 also includes a number of terminal grooves 60 cut in the interior socket wall 52. As seen in FIGS. 2 and 5, terminal groove 60 in this embodiment of the claimed apparatus has two portions. First portion 62 is parallel to the central axis of socket 50, while second portion 64 intersects with first portion 62. Second portion 64 also has a notch 66.

Socket 50 further includes a number of resilient interior socket contacts 80. Each interior socket contact 80 is an electrically conductive member disposed in second portion 64, and projecting from the floor 54 of socket 50. Interior socket contacts 80 are electrically connected to a corresponding number of exterior wire contacts 88 disposed on the exterior of socket 50.

When end cap 10 is inserted into socket 50, each of the outer end cap terminals 20 align with first portion 62 of a terminal groove 60. As end cap 10 is inserted into socket 50, outer end cap terminals 20 slide along first portion 62. When outer end cap terminals 20 reach the intersection of first portion 62 and second portion 64, end cap 10 can be rotated such that outer end cap terminals 20 slide along second portions 64 until they reach notch 66 with "smooth action."

Upon reaching notch 66, outer end cap terminals 20 displace interior socket contacts 80 as end cap 10 is rotated. Interior socket contacts 80 project from floor 54 of socket 50 in such a way that the elasticity of interior socket contacts 80 causes each interior socket contact 80 to press against the corresponding outer end cap terminal 20. This contact causes each interior socket contact 80 to be electrically connected to the corresponding outer end cap terminal 20.

Additionally, the elasticity of interior socket contact 80 creates a biasing force that presses against outer end cap terminal 20, thus pushing outer end cap terminal 20 into notch 66. The biasing force keeps outer end cap terminal 20 fixed in a fixed position in notch 66. When fixed in such a position, end cap 10 is locked in place within socket 50 so as to maintain electrical contact between outer end cap terminals 20 and interior socket contacts 80.

Figure 6:
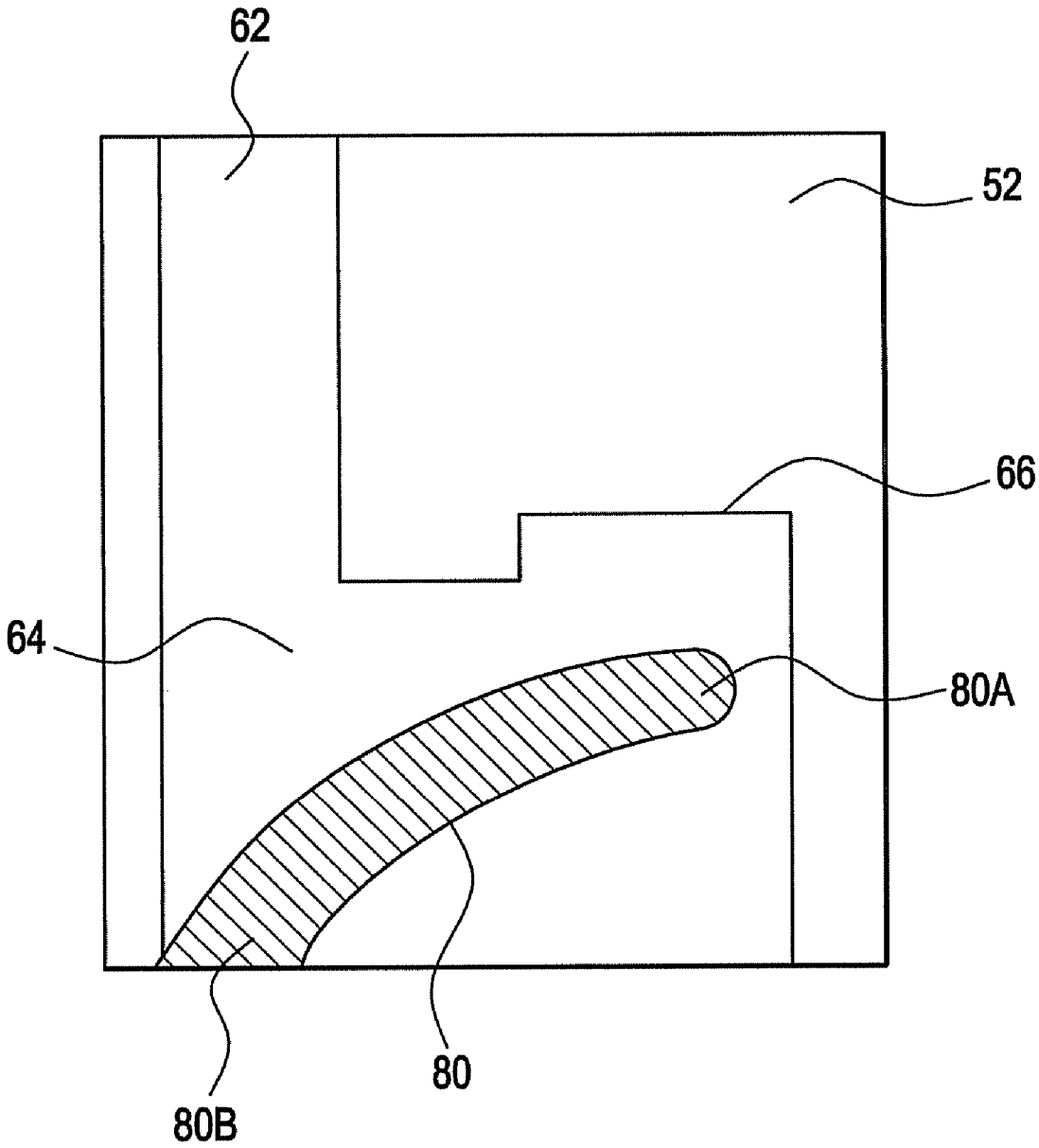
FIG. 6 is a cross-sectional view of a quarter portion of a socket according to one embodiment of the invention.

Thus, in accordance with an embodiment, for example as shown in FIGS. 1 and 2, (see FIG. 15 for multiple lamps), a safety lamp connector apparatus is provided for use with at least one or more lamps 40 comprising an end cap 10 for the lamp, the end cap 10 comprising a hollow tubular section for receiving the lamp 40; a plurality of outer end cap terminals 20 extending radially outwards from the hollow tubular section; and a plurality of inner end cap terminals 22 electrically connected to the plurality of outer end cap terminals 20; and a smooth action twist socket 50 for receiving the end cap 10, the twist socket 50 comprising: an interior socket wall 52; a plurality of straight and axially oriented terminal grooves 60 cut into the interior socket wall; a plurality of straight horizontal grooves 64 each connected to the axially oriented terminal grooves 60 at a predetermined and individually set depth inside the socket 50 and orientated substantially perpendicular to the axially orientated grooves 60. Also, as shown in FIG. 6, a plurality of smooth action and resiliently biased metal interior curved socket contacts 80 may be present, having a base end 80*b* located towards the bottom of the straight and axially orientated grooves 60 and also having a top end 80*a* which is resiliently biased towards the top of a respective straight horizontal groove 64 so as to structural form a curved resilient member 80 which can be depressed towards the bottom of the twist socket by insertion of, and then the twisting of, a respective outer cap terminal 20 on the end cap 10; and locking cut out sections or which may be notches 66 located at the end of the straight horizontal grooves 64 in which the respective outer cap terminal 20 on the end cap click locks with an axial motion, and comes to rest in the locking cut out section 66, by being pressed axially by a respective resiliently biased metal interior curved socket contact 80 upon being fully twisted into final position after sliding tangentially along the respective resiliently biased metal interior curved socket contact 80; an exterior access contact which may be an exterior wire contact 88 for example that is electrically connected to the interior socket contact for connecting wires or any desired electrical power source; and wherein the end cap 10 is structured to be inserted into the socket 50 such that each outer end cap terminal 20 is inserted into a matching sized terminal groove 60, and each outer end cap terminal 20 contacts a respective resiliently biased metal interior curved socket contact 80, and subsequently has a smooth action when twisted.

Thus, this present locking and smooth action operation apparatus overcomes the problems of the prior art discussed in the background at least because the lamp may be easily secured with minimal force, i.e., a "smooth action" in contrast to a much more "difficult depress with more force and turn" two step motion of U.S. Pat. No. 6,334,902, or harder torque force required of U.S. Pat. No. 6,884,103, and will lock into place and remain secure even under vibration, such as vibration from water or air flowing through a disinfection apparatus to be disinfected even when hung vertically. It is also much smoother to operate than WO 2006/136026 for example and does not require to be inserted at an odd an awkward angle like WO 2006/136026. Thus, the present invention is also not merely a common sense improvement of the prior art at least because it requires many subtle features to be recognized and used in harmony, as described herein, which the prior art has not recognized to date, and has also not obviously been led to perform by common sense.

The present invention also is very safe because the electrical contacts 80 in the socket 50 are difficult to reach with a finger, i.e., they are tucked away in a safe position from the user. Also, another safety problem with the prior art approaches is the complexity of the mechanical connection between the lamp and the base unit requiring the use of complex shaped springs, specialized connection lugs and the like. Further, a connection system that is predicated on a dual motion system such that if hard force pushing and twisting if used incorrectly for example may give rise to higher incidents of lamp breakage, electrical shock, and other damage to the lamp by field personal. Therefore, eliminating a forceful "push" necessary to deflect a heavy locking spring in a "push and twist" lock would be beneficial because the typically fragile glass lamp would then be subject to reduced force and stress. Thus, the present invention with its "smooth action" is much safer and easier to use.

Also, to smoothly disengage end cap 10 from socket 50 when in the locked position, end cap 10 is lightly pushed further into socket 50. This causes outer end cap terminals 20 to displace interior socket contacts 80 so that outer end cap terminals 20 can slide out of notches 66. End cap 10 can then be smoothly rotated until each outer end cap terminal 20 aligns with first portion 62 of terminal groove 60. Once outer end cap terminals 16 align with the respective first portions 62, end cap 10 can be easily removed from socket 50.

Figure 7A:
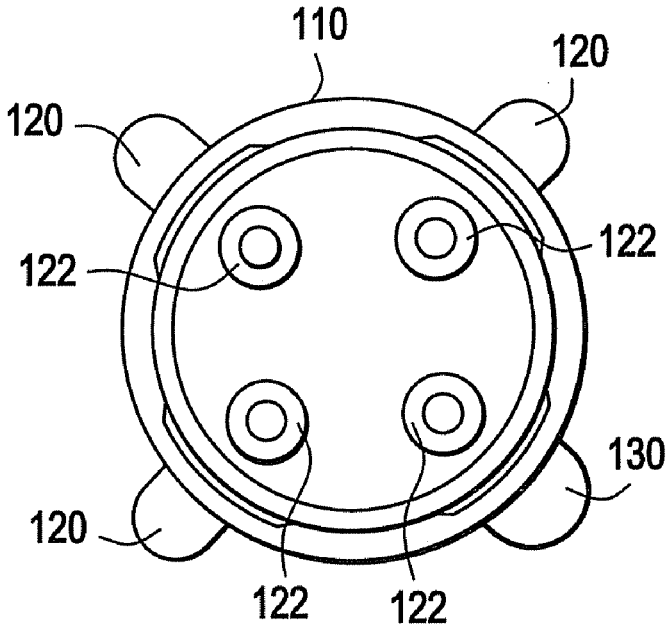
FIG. 7*a* is a top view looking down into an end cap having a large end cap terminal according to one embodiment of the invention.
Figure 7B:
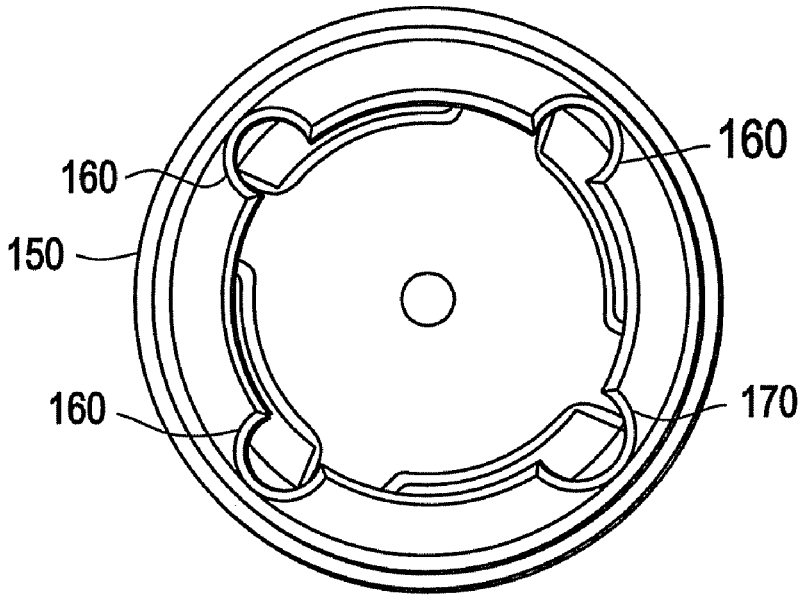
FIG. 7*b* is a top view looking down into a socket having a large terminal groove according to one embodiment of the invention.

In an alternative embodiment, show particularly in FIGS. 7*a* and 7*b*, one of the outer end cap terminals is a large end cap terminal 130. Large end cap terminal 130 is made larger than at least one of the other outer end cap terminals 120. Accordingly, one of the terminal grooves on socket 150 is a large terminal groove 170.

When an end cap 110 with a large end cap terminal 130 is inserted into socket 50, large end cap terminal 130 must align with large terminal groove 170. If one attempts to align large end cap terminal 130 with a regular sized terminal groove 160, large end cap terminal 130 is too large to insert into terminal groove 160 and end cap 110 cannot be inserted into socket 150. Thus, proper insertion requires that large end cap terminal 130 aligns with large terminal groove 170.

Figure 8A:
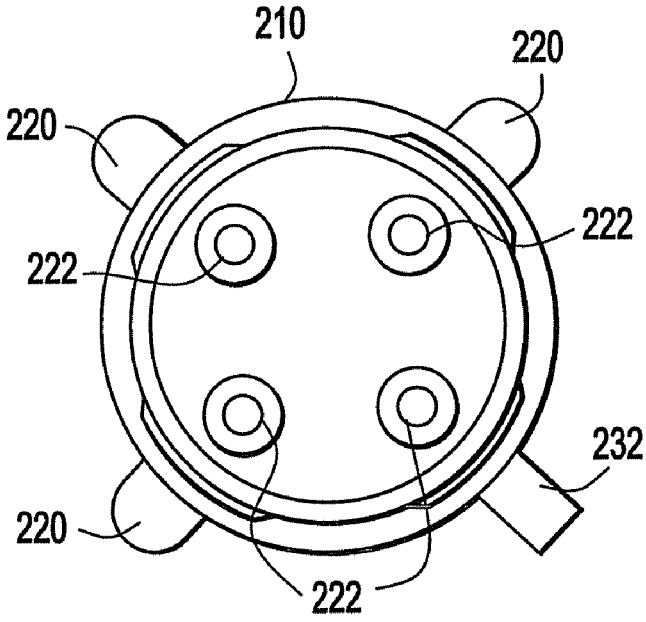
FIG. 8*a* is a top view looking down into an end cap having a small end cap terminal according to one embodiment of the invention.
Figure 8B:
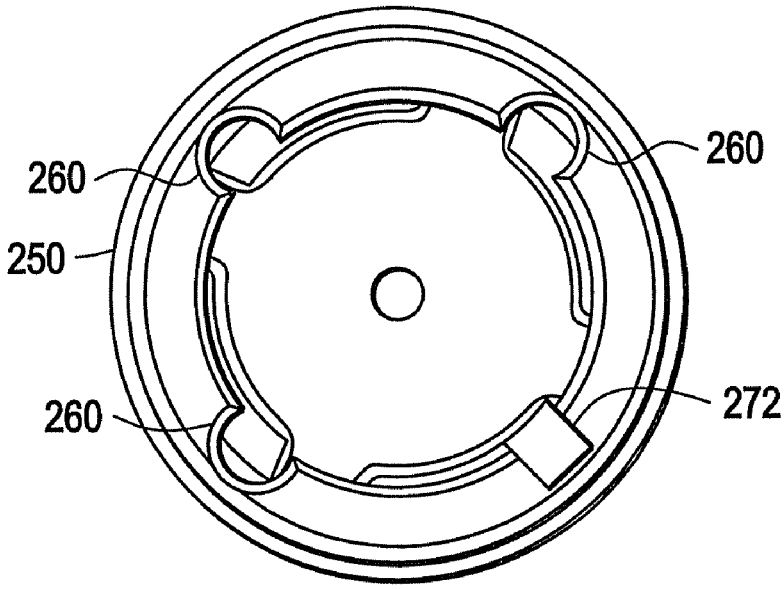
FIG. 8*b* is a top view looking down into a socket having a small terminal groove according to one embodiment of the invention.

Another embodiment of the claimed apparatus is shown in FIGS. 8*a* and 8*b*. In this embodiment, end cap 210 has a small end cap terminal 232. Small end cap terminal 232 is made smaller than at least one of the other outer end cap terminals 220. Accordingly, one of the terminal grooves on socket 250 is a small terminal groove 272.

When an end cap 210 with a small end cap terminal 232 is inserted into socket 250, small end cap terminal 232 must align with small terminal groove 272. If one attempts to align a regular sized outer end cap terminal 220 with small terminal groove 272, outer end cap terminal 220 is too large to insert into small terminal groove 272 and end cap 210 cannot be inserted into socket 250. Thus, proper insertion requires that small end cap terminal 232 aligns with small terminal groove 272.

Figure 9A:
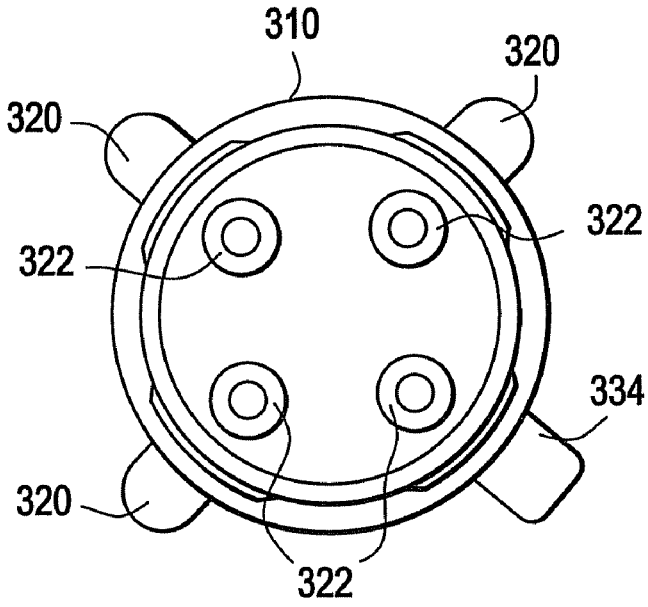
FIG. 9*a* is a top view looking down into an end cap having an asymmetrical end cap terminal according to one embodiment of the invention.
Figure 9B:
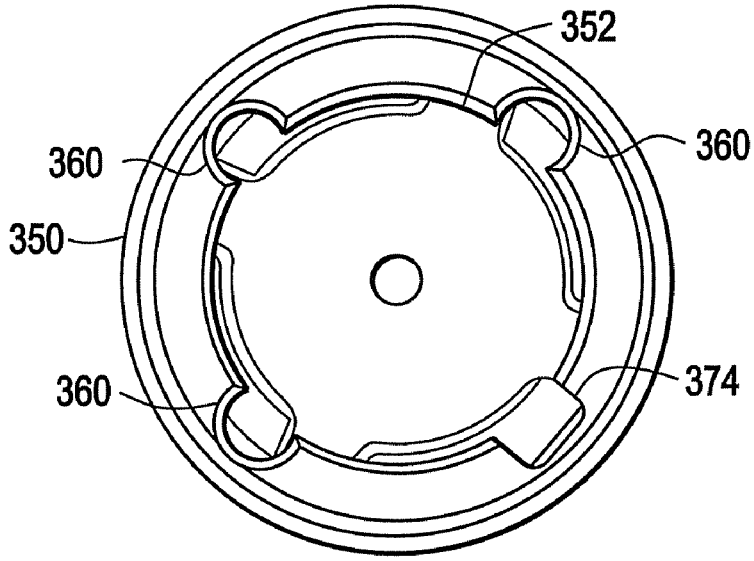
FIG. 9*b* is a top view looking down into a socket having an asymmetrical terminal groove according to one embodiment of the invention.
Figure 10A:
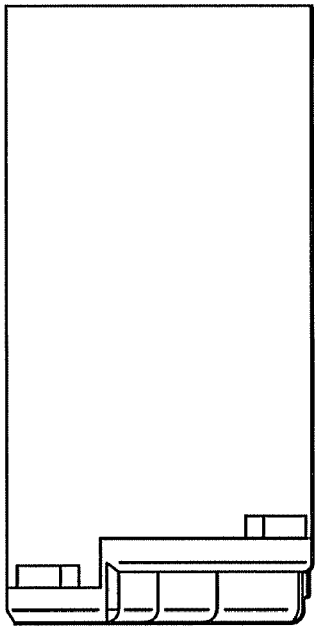
FIG. 10*a* is a side view of an end cap having a recessed portion according to one embodiment of the invention.
Figure 10B:
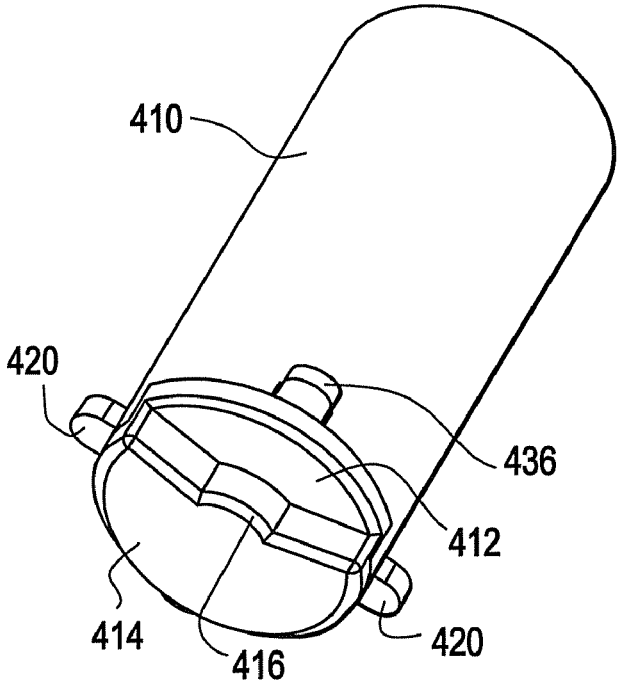
FIG. 10*b* is a perspective view of an end cap having a recessed portion according to one embodiment of the invention.
Figure 10C:
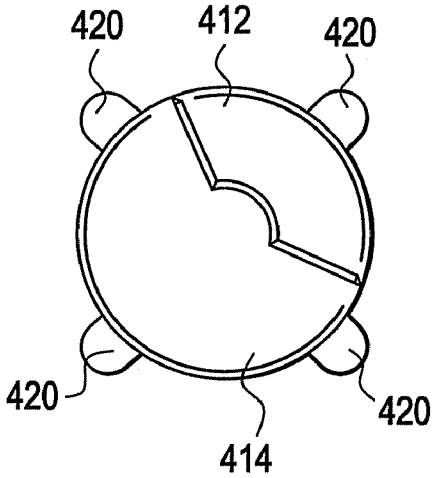
FIG. 10*c* is a bottom view of an end cap having a recessed portion according to one embodiment of the invention.
Figure 10D:
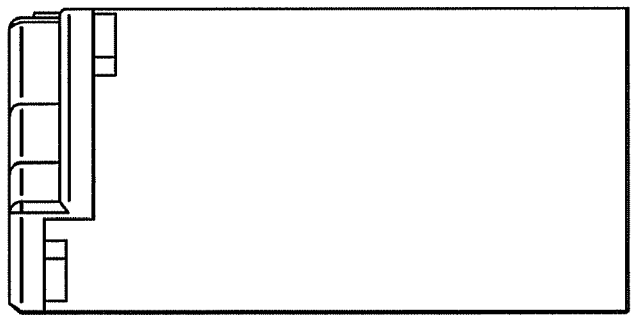
FIG. 10D is a side view of an end cap having a recessed portion according to one embodiment of the invention.
Figure 11A:
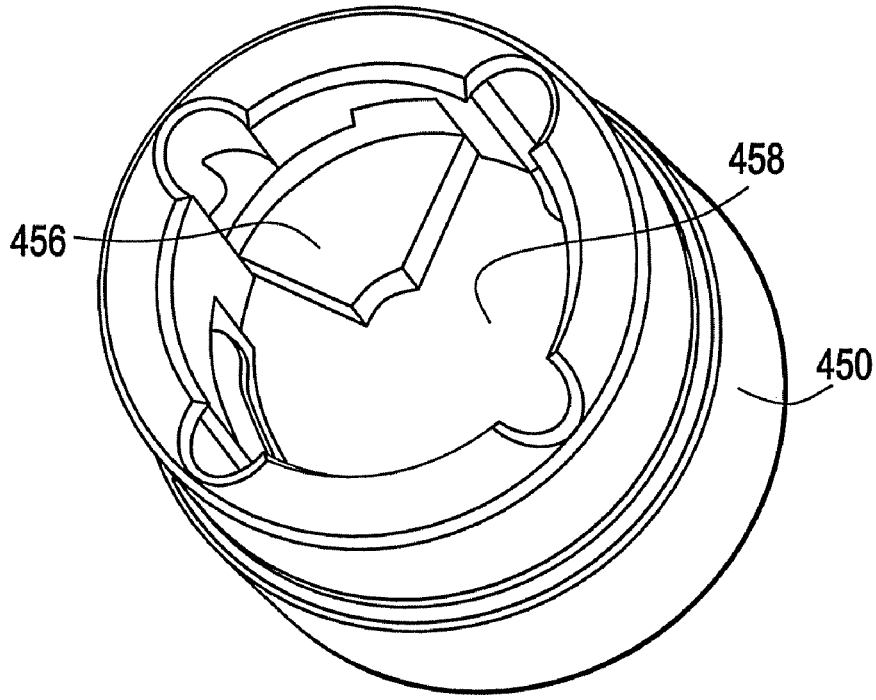
FIG. 11*a* is a perspective view of a socket having a stepped portion according to one embodiment of the invention.
Figure 11B:
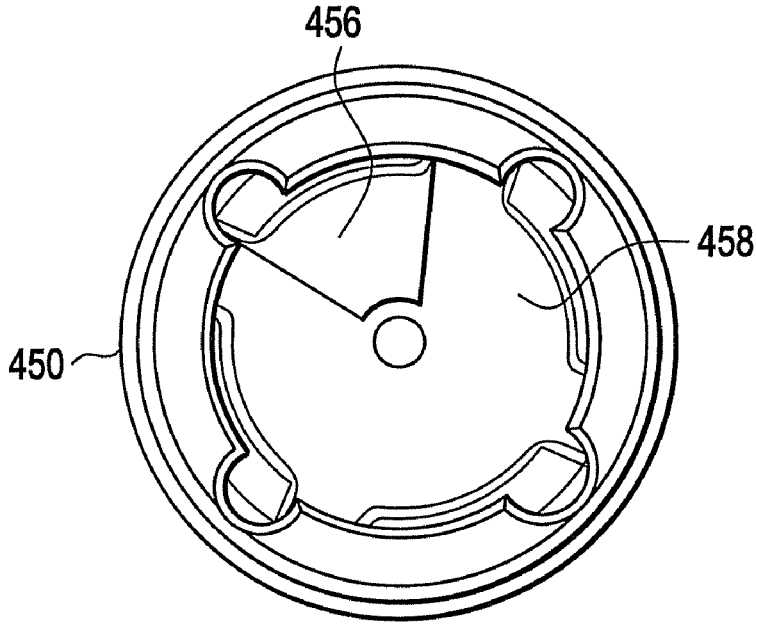
FIG. 11*b* is a top view of a socket having a stepped portion according to one embodiment of the invention.

In another embodiment, shown specifically in FIGS. 9*a* and 9*b*, end cap 310 has an asymmetric end cap terminal 334. Asymmetric end cap terminal 334 is displaced along the outer surface of end cap 310 such that it creates an asymmetric arrangement with outer end cap terminals 320. In FIG. 7, for example, one can see how the outer end cap terminals 220 and small end cap terminal 232 are arranged symmetrically; that is, each outer end cap terminal 220 is directly across from another outer end cap terminal 220 or small end cap terminal 232. In contrast, in FIG. 8, asymmetric end cap terminal 334 has been moved slightly in the clockwise direction on the outer surface of end cap 310, such that it is no longer directly across from opposite outer end cap terminal 360. Accordingly, socket 350 has an asymmetric terminal groove 374 that has been placed in an orientation complementary to asymmetric terminal groove 374.

When an end cap 310 with an asymmetric end cap terminal 334 is inserted into socket 350, asymmetric end cap terminal 334 must align with asymmetric terminal groove 374. If one attempts to align asymmetric end cap terminal with any of terminal grooves 360, then outer end cap terminals 320 will not properly align with a terminal groove and end cap 310 cannot be inserted into socket 350. Thus, proper insertion requires that asymmetric end cap terminal 334 aligns with asymmetric terminal groove 374.

Another embodiment of the claimed apparatus is shown in FIGS. 10*a*, 10*b*, 11*a*, and 11*b*. In this embodiment, end cap 410 has a closed end 416. The outer surface of closed end 416 is divided into recessed portion 412 and non-recessed portion 414. Recessed portion 412 is elevated above non-recessed portion 414. The floor of socket 450 is divided into a stepped portion 456 and a non-stepped portion 458. Stepped portion 456 is raised above non-stepped portion 458.

To insert end cap 410 into stepped socket 450, one must align recessed portion 412 with stepped portion 456. If one tries to insert recessed end cap 410 with non-recessed portion 414 with stepped portion 456, non-recessed portion 414 will collide with stepped portion 456, and end cap 410 will not be fully inserted into socket 450. Thus, proper insertion requires that recessed portion 412 aligns with stepped portion 456. Then, end cap 410 can be rotated and twist locked into place because stepped portion 456 is smaller than recessed portion 412.

Figure 12A:
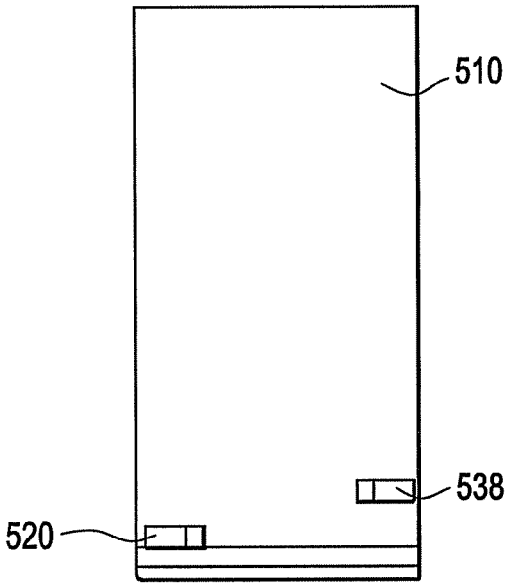
FIG. 12*a* is a side view of an end cap having an elevated terminal according to one embodiment of the invention.
Figure 12B:
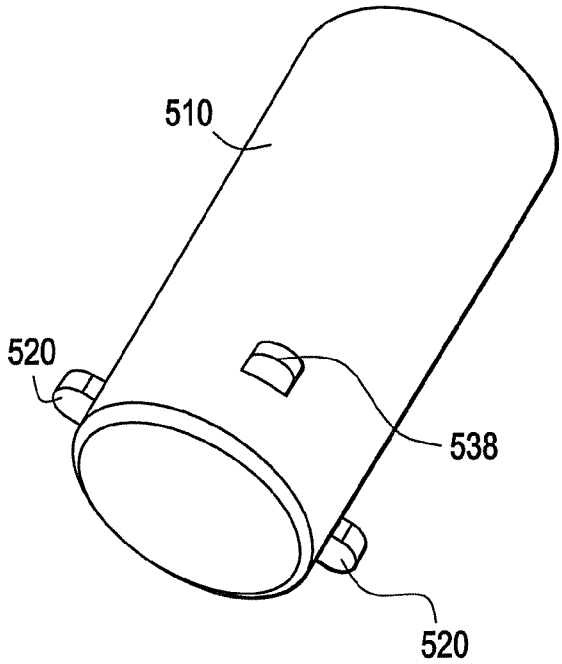
FIG. 12*b* is a perspective view of an end cap having an elevated terminal according to one embodiment of the invention.
Figure 12C:
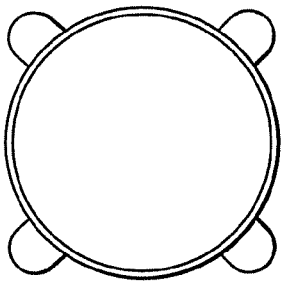
FIG. 12*c* is a bottom view of an end cap having an elevated terminal according to one embodiment of the invention.
Figure 12D:
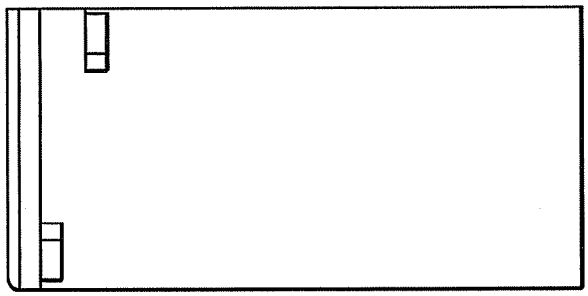
FIG. 12*d* is a side view of an end cap having an elevated terminal according to one embodiment of the invention.
Figure 13:
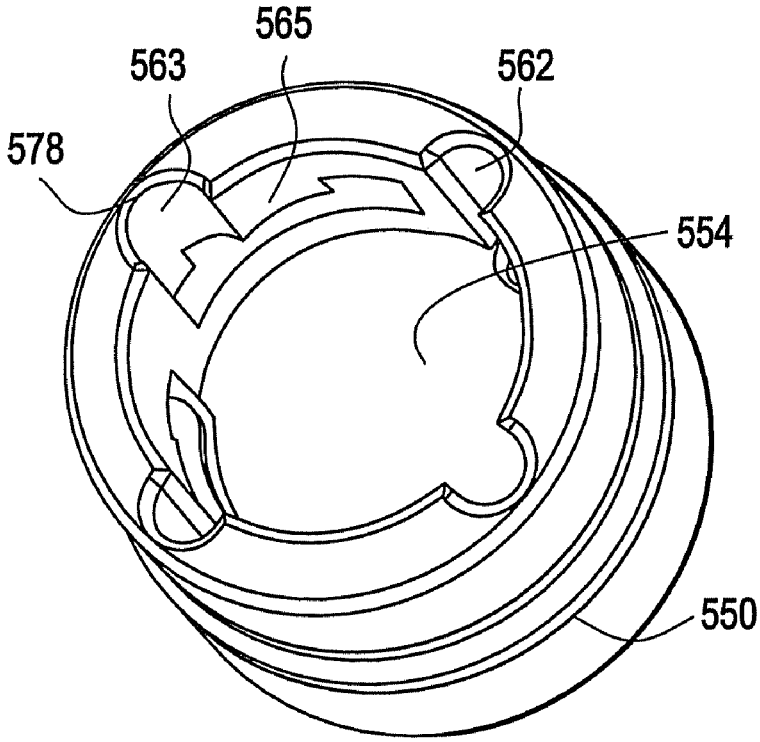
FIG. 13 is a perspective view of a socket having a shallow terminal groove according to one embodiment of the invention.

Another embodiment of the claimed apparatus is shown in FIGS. 12*a*, 12*b*, and 13. In this embodiment, end cap 510 has an elevated end cap terminal 538. Elevated end cap terminal 538 is raised above the level of at least one outer end cap terminal 520. Accordingly, socket 550 has a shallow terminal groove 578. Shallow terminal groove 578 comprises shortened first portion 563 and elevated second portion 565. Shortened first portion 563 is shorter than regular first portion 562, and elevated second portion 565 is raised above floor 554 of socket 550.

When end cap 510 with elevated end cap terminal 538 is inserted into socket 550, elevated end cap terminal 538 must align with shallow terminal groove 578. If one attempts to align an outer end cap terminal 520 with shallow terminal groove 578, outer end cap terminal 520 will reach the bottom of first portion 578 and the other outer end cap terminals 520 and elevated end cap terminal 538 will be sufficiently inserted for end cap 510 to rotate within socket 550. Thus, proper insertion requires that elevated end cap terminal 538 aligns with small terminal groove 578.

In addition to providing for proper insertion of the end cap into the socket, the previous terminal and terminal groove configurations described above also help to prevent the substitution of unsafe rated wattages or unauthorized third party or generic parts into the assembly. For example, a third party may also manufacture a type of end cap for receiving a lamp. However, it is unlikely that the third party end cap will be usable with the sockets described above because the third party manufacturer is unlikely to manufacture end caps having the precise configuration that matches the configuration of the terminal grooves on the socket.

In addition to the structures described above, the end cap and socket apparatus can also include a "key" system for insuring proper orientation as well as deterring the use of counterfeit or copied parts. The key comprises a small portion that extends out from the periphery of the end cap housing or from the interior socket wall of the socket. The key fits into a complementary key groove on the complementary piece, thus insuring proper alignment and making it difficult to substitute third-party or generic parts.

Figure 14:
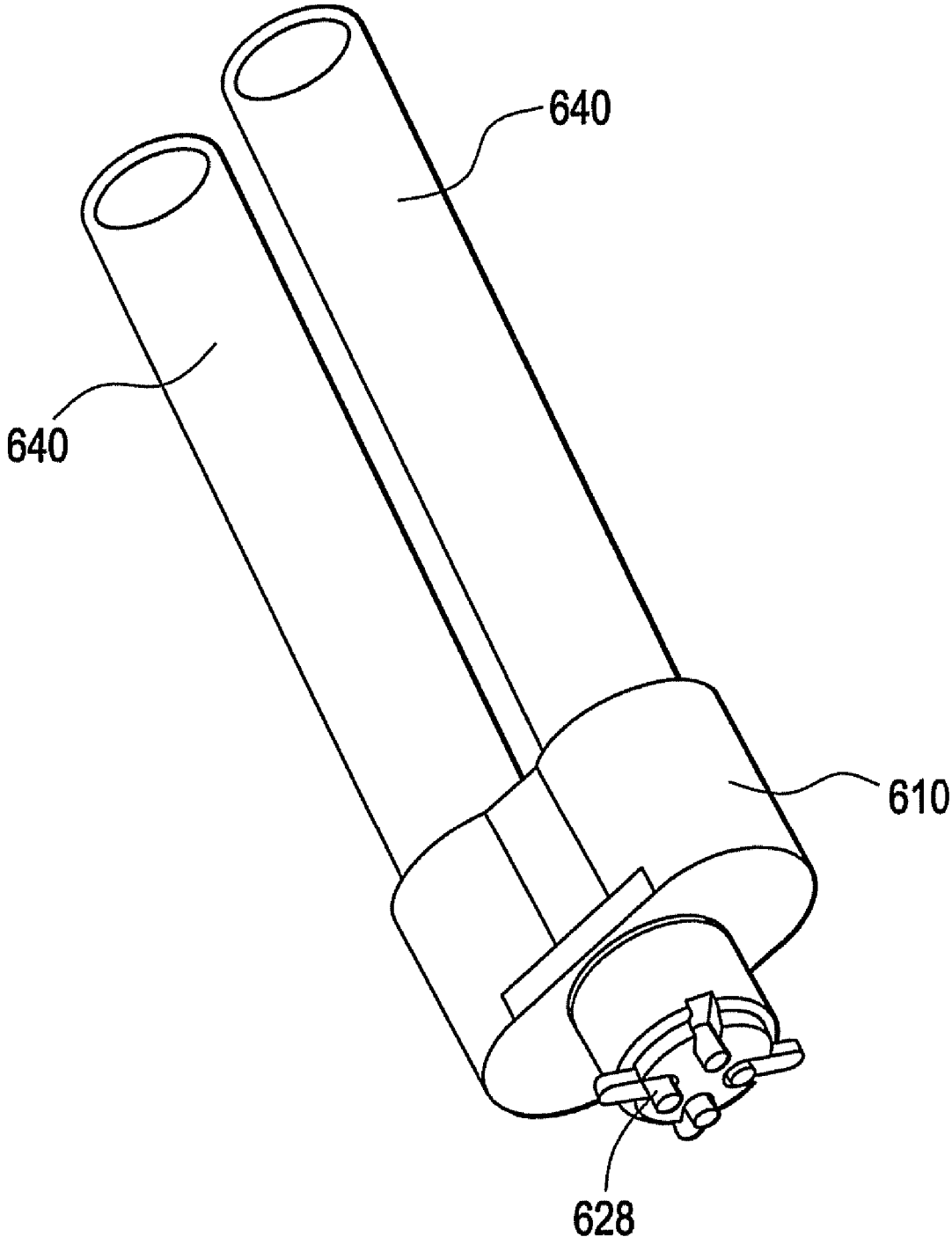
FIG. 14 is a perspective view of a multi-lamp end cap with inserted lamps, according to one embodiment of the invention.

Another embodiment of the claimed invention is shown in FIG. 14. The end cap 610 can be configured to receive multiple lamps. In the particular embodiment shown in FIG. 14, end cap 610 is configured to receive and electrically connect two lamps 640. Also shown in FIG. 14 is exterior nub 628. Nub 628 can be integrally attached to the outer end cap terminals, or they may be a separate structure. Nub 628 can be used for supporting the end cap on the floor of the socket, among other applications. Additionally, the nub structure shown by nub 628 can be used in the single lamp end cap embodiments as well, and is not just limited to the multi-lamp end cap shown in FIG. 14.

Figure 15:
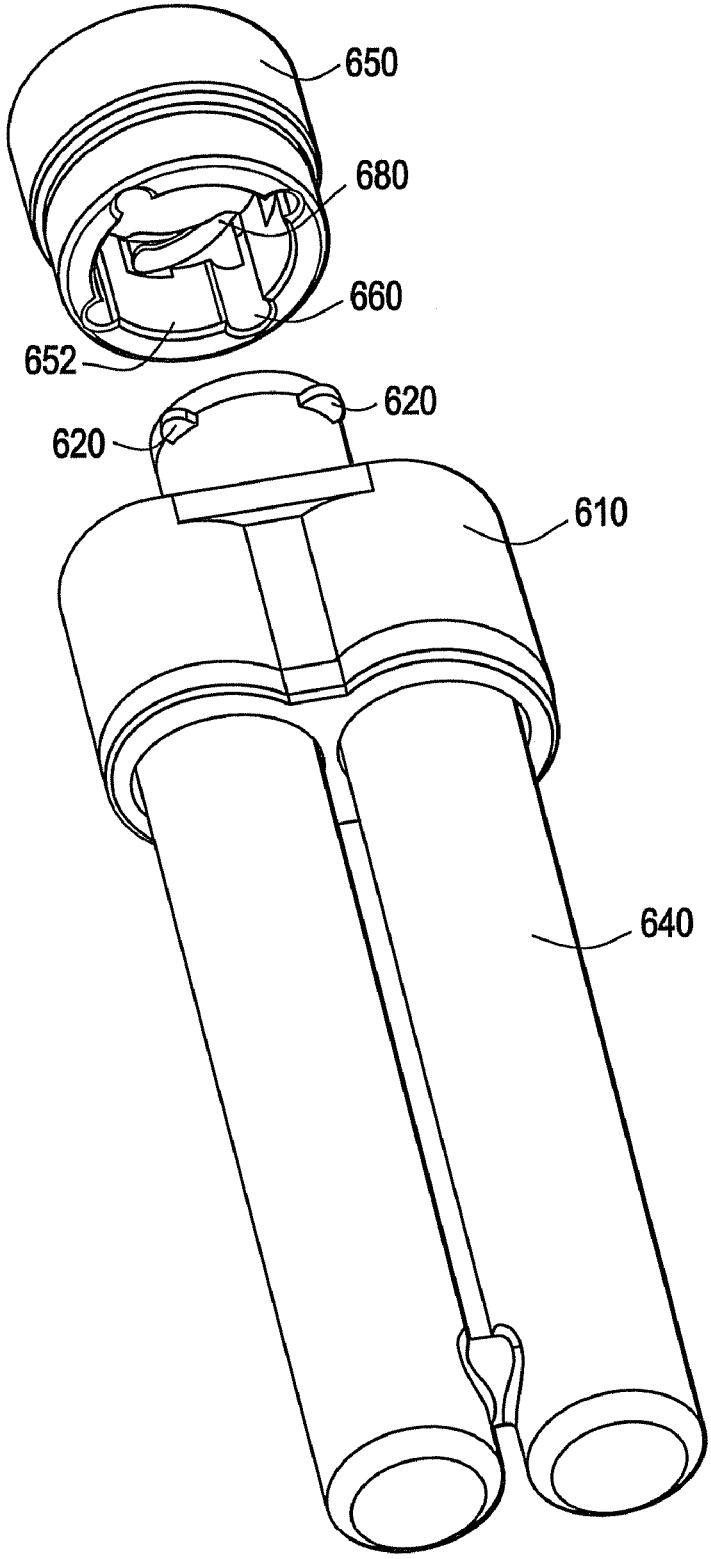
FIG. 15 is a perspective view of a disassembled multi-lamp end cap with inserted lamps and socket, according to one embodiment of the invention.
Figure 16A:
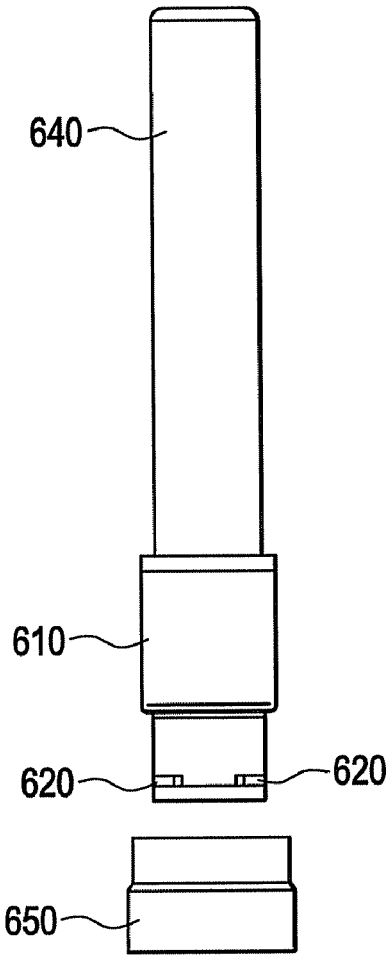
FIG. 16*a* is a side view of a disassembled multi-lamp end cap with inserted lamps and socket, according to one embodiment of the invention.
Figure 16B:
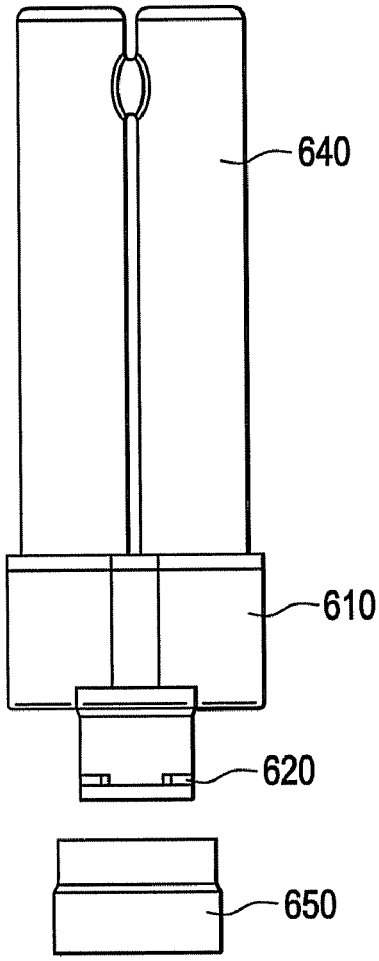
FIG. 16*b* is a side view of a disassembled multi-lamp end cap with inserted lamps and socket, rotated 90 degrees from the view in FIG. 16*a*, according to one embodiment of the invention.
Figure 16C:
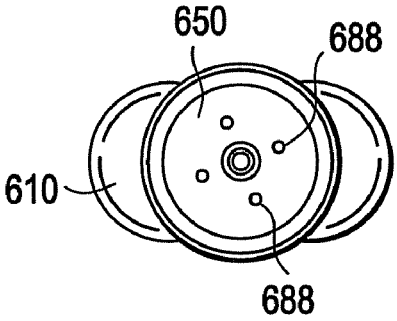
FIG. 16*c* is a bottom view of a disassembled multi-lamp end cap with inserted lamps and socket, according to one embodiment of the invention.
Figure 17A:
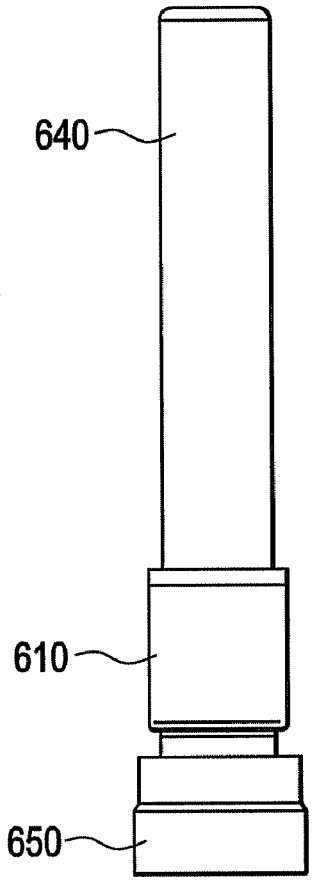
FIG. 17*a* is a side view of an assembled multi-lamp end cap with inserted lamps and socket, according to one embodiment of the invention.
Figure 17B:
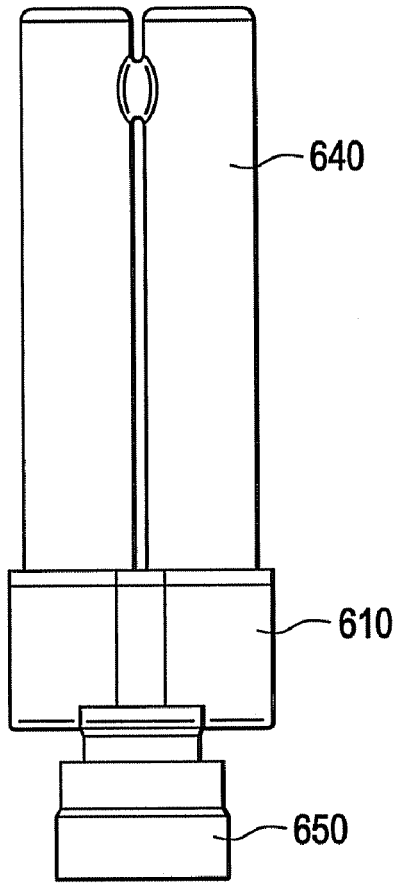
FIG. 17*b* is a side view of an assembled multi-lamp end cap with inserted lamps and socket, rotated 90 degrees from the view in FIG. 16*a*, according to one embodiment of the invention.
Figure 17C:
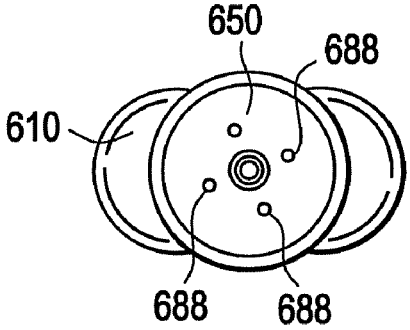
FIG. 17C is bottom view of an assembled multi-lamp end cap with inserted lamps and socket, according to one embodiment of the invention.

As shown in FIG. 15, end cap 610 has outer end cap terminals 620 that can be inserted into terminal grooves 660 of socket 650. Socket 650 is similar in structure to the sockets of the other embodiments described above. For example, socket 650 can include an interior socket wall 652 with terminal grooves 600 cut therein. Additionally, each terminal groove 660 can have a interior socket contact contained therein. Furthermore, the underside of socket 650 can have exterior wire contacts 688.

Figure 18A:
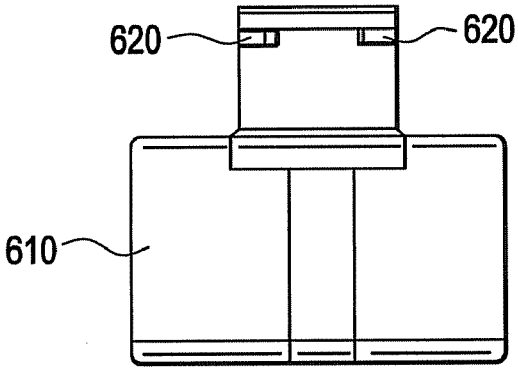
FIG. 18*a* is a side view of multi-lamp end cap without lamps, according to one embodiment of the invention.
Figure 18B:
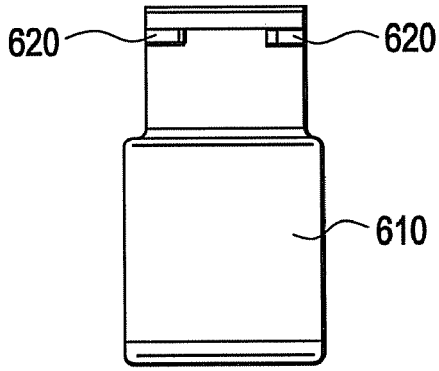
FIG. 18*b* is a side view of a multi-lamp end cap without lamps, rotated 90 degrees from the view in FIG. 18*a*, according to one embodiment of the invention.
Figure 18C:
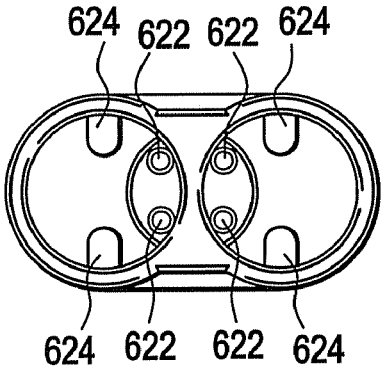
FIG. 18*c* is a top view of a multi-lamp end cap without lamps, according to one embodiment of the invention.
Figure 18D:
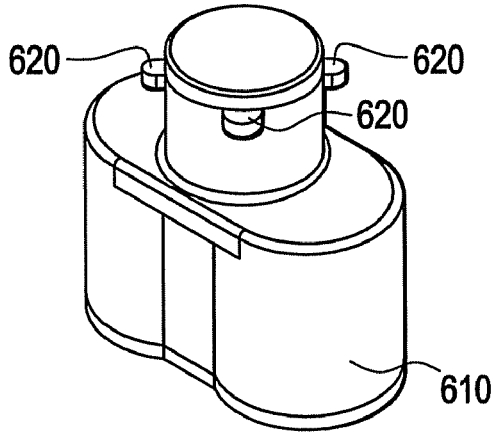
FIG. 18*d* is a perspective view of a multi-lamp end cap without lamps, according to one embodiment of the invention.
Figure 19:
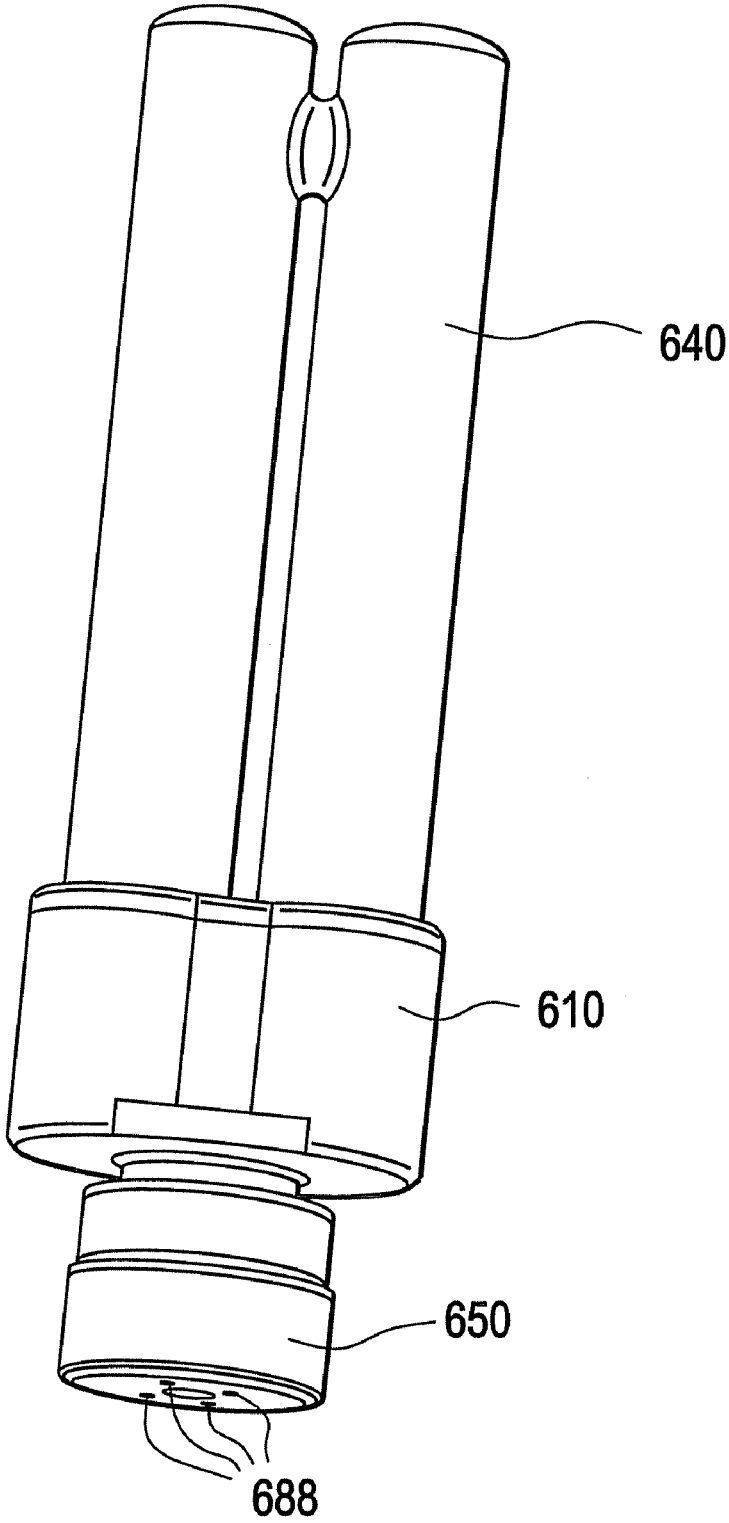
FIG. 19 is a perspective view of an assembled multi-lamp end cap with inserted lamps and socket, according to one embodiment of the invention.

In some applications, having multiple lamps 640 may require having additional contacts and/or terminals on the inside of end cap 610. Therefore, as shown in FIG. 18*c*, end cap 610 can be configured to include additional interior end cap terminals 624, in addition to the standard interior end cap terminals 622 as described in other embodiments above.

It should also be noted that all of the above alignment and copy-protection safety structures described above, including but not limited to large exterior end cap terminals, small exterior end cap terminals, asymmetrical exterior end cap terminals, stepped and recessed structures, and elevated exterior end cap terminals, also can be used in conjunction with a multi-bulb end cap such as end cap 610.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A safety lamp connector apparatus for use with at least one or more lamps comprising:

an end cap for the lamp, the end cap comprising:

a hollow tubular section for receiving the lamp;

a plurality of outer end cap terminals extending radially outwards from the hollow tubular section; and a plurality of inner end cap terminals electrically connected to the plurality of outer end cap terminals; and a smooth action twist socket for receiving the end cap, the twist socket comprising:

an interior socket wall;

a plurality of straight and axially oriented terminal grooves cut into the interior socket wall;

a plurality of straight horizontal grooves each connected to the axially oriented terminal grooves at a predetermined and individually set depth inside the socket and orientated substantially perpendicular to the axially orientated grooves;

a plurality of smooth action and resiliently biased metal interior curved socket contacts having a base end located towards the bottom of the straight and axially orientated grooves and also having a top end which is resiliently biased towards the top of a respective straight horizontal groove so as to structural form a curved resilient member which can be depressed towards the bottom of the twist socket by insertion of, and then the twisting of, a respective outer cap terminal on the end cap; and locking cut out sections located at the end of the straight horizontal grooves in which the respective outer cap terminal on the end cap click locks with an axial motion, and comes to rest in the locking cut out section, by being pressed axially by a respective resiliently biased metal interior curved socket contact upon being fully twisted into final position after sliding tangentially along the respective resiliently biased metal interior curved socket contact;

an exterior access contact electrically connected to the interior socket contact for connecting wires or any desired electrical power source; and wherein the end cap is structured to be inserted into the socket such that each outer end cap terminal is inserted into a matching sized terminal groove, and each outer end cap terminal contacts a respective resiliently biased metal interior curved socket contact, and subsequently has a smooth action when twisted.

2. The safety lamp connector of claim 1, wherein at least one of the plurality of outer end cap terminals is a different size or shape than the rest of the plurality of outer end cap terminals; and at least one of the plurality of terminal grooves is a different size or shape than the rest of the plurality of terminal grooves.

3. The safety lamp connector of claim 1, wherein the plurality of outer end cap terminals comprises:

a large outer end cap terminal, the large outer end cap terminal being larger than at least one of the plurality of outer end cap terminals; and the plurality of terminal grooves comprises:

a large terminal groove, the large terminal groove being larger than at least one of the plurality of terminal grooves;

wherein the end cap can be rotated within the socket only if the larger outer end cap terminal is inserted into the large terminal groove.

4. The safety lamp connector of claim 1, wherein the plurality of outer end cap terminals comprises:

a smaller outer end cap terminal, the smaller outer end cap terminal being smaller than at least one of the plurality of outer end cap terminals; and the plurality of terminal grooves comprises:

a smaller terminal groove, the smaller terminal groove being smaller than at least one of the plurality of terminal grooves;

wherein the end cap can be rotated within the socket only if the smaller outer end cap terminal is inserted into the smaller terminal groove.

5. The safety lamp connector of claim 1, wherein the plurality of outer end cap terminals are disposed asymmetrically on an outer surface of the end cap; and the plurality of terminal grooves are disposed so as to receive the asymmetrically distributed outer end cap terminals.

6. The safety lamp connector of claim 1, wherein the plurality of outer end cap terminals comprises:

an elevated outer end cap terminal, wherein the elevated outer end cap terminal and at least one of the plurality of outer end cap terminals are disposed on different planes perpendicular to a longitudinal axis of the end cap; and the plurality of terminal grooves comprises:

a shallow terminal groove, the shallow terminal groove being shallower than at least one of the plurality of terminal grooves;

wherein the end cap can only be rotated within the socket if the elevated outer end cap terminal is inserted into the shallow terminal groove.

7. The safety lamp connector of claim 1, wherein the end cap further comprises:

a closed end having an outer surface, the outer surface comprising a recessed portion and a non-recessed portion; and the socket further comprises a closed end having an interior surface, the interior surface having a stepped portion;

wherein the end cap can only be fully inserted into the socket if the recessed portion aligns with the stepped portion and the end cap cannot be inserted if the non-recessed portion is aligned with the stepped portion.

8. The safety lamp connector of claim 1, wherein the end cap is configured to receive a plurality of lamps therein, the plurality of lamps being electrically connected to the inner end cap terminal.

9. The safety lamp connector of claim 1, wherein the end cap is structured to accept one or more Ultra-Violet (UV) wavelength lamps.

* * * * *